US009863015B2

(12) United States Patent
Wang et al.

(10) Patent No.: US 9,863,015 B2
(45) Date of Patent: *Jan. 9, 2018

(54) MANUFACTURING METHOD FOR STRIP CASTING 550 MPA-GRADE HIGH STRENGTH ATMOSPHERIC CORROSION-RESISTANT STEEL STRIP

(71) Applicant: Baoshan Iron & Steel Co., Ltd., Shanghai (CN)

(72) Inventors: Xiufang Wang, Shanghai (CN); Yuan Fang, Shanghai (CN); Yan Yu, Shanghai (CN); Jianchun Wu, Shanghai (CN); Bo Qin, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/371,053

(22) PCT Filed: Feb. 18, 2013

(86) PCT No.: PCT/CN2013/000153

§ 371 (c)(1),
(2) Date: Jul. 8, 2014

(87) PCT Pub. No.: WO2013/135097

PCT Pub. Date: Sep. 19, 2013

(65) Prior Publication Data

US 2015/0007913 A1 Jan. 8, 2015

(30) Foreign Application Priority Data

Mar. 14, 2012 (CN) ..... 2012 1 0067081

(51) Int. Cl.
*C21D 8/02* (2006.01)
*C21D 8/00* (2006.01)
(Continued)

(52) U.S. Cl.
CPC ..... *C21D 8/0215* (2013.01); *B22D 11/002* (2013.01); *B22D 11/0622* (2013.01);
(Continued)

(58) Field of Classification Search
CPC ..... C21D 8/00; C21D 9/52; C22C 38/001; C22C 38/02; C22C 38/04
See application file for complete search history.

(56) References Cited

U.S. PATENT DOCUMENTS 5,996,680 A * 12/1999 Fukase et al. ..... 164/428
2001/0004910 A1* 6/2001 Yasuhara et al. ..... 148/546
(Continued)

FOREIGN PATENT DOCUMENTS

CN 101481778 A 7/2009
CN 101684537 A 3/2010
(Continued)

OTHER PUBLICATIONS

PCT International Search Report for PCT Application No. PCT/CN2013/000153 dated May 23, 2013 (6 pages).
(Continued)

*Primary Examiner* — Rebecca Lee
(74) *Attorney, Agent, or Firm* — Eversheds Sutherland (US) LLP

(57) ABSTRACT

A manufacturing method for strip casting 550 MPa-grade high strength atmospheric corrosion-resistant steel strip, comprising the following steps: 1) smelting, where the chemical composition of a molten steel is that: C is between 0.03-0.08%, Si≤0.4%, Mn is between 0.6-1.5%, P is between 0.07-0.22%, S≤0.01%, N≤0.012%, Cu is between 0.25-0.8%, Cr is between 0.3-0.8%, and Ni is between 0.12-0.4%, additionally, also comprised is at least one micro-alloying element among Nb, V, Ti, and Mo, where Nb is between 0.01-0.08%, V is between 0.01-0.08%, Ti is
(Continued)

between 0.01-0.08%, and Mo is between 0.1-0.4%, and where the remainder is Fe and unavoidable impurities; 2) strip casting, where a 1-5 mm-thick cast strip is casted directly; 3) cooling the strip, where the cooling rate is greater than 20° C./s; 4) online hot rolling the cast strip, where the hot rolling temperature is between 1050-1250° C., where the reduction rate is between 20-50%, and where the deformation rate is >20 $s^{-1}$; austenite online recrystallizing after hot rolling, where the thickness of the hot rolled strip is between 0.5-3.0 mm; and, 5) cooling and winding, where the cooling rate is between 10-80° C./s, and where the winding temperature is between 570-720° C. The microscopic structure of a steel strip acquired is primarily constituted by fine polygonal ferrite and pearlite.

13 Claims, 1 Drawing Sheet

(51) Int. Cl.

| | |
|---|---|
| ***C22C 38/00*** | (2006.01) |
| ***C21D 9/52*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***B22D 11/00*** | (2006.01) |
| ***B22D 11/06*** | (2006.01) |
| *B21B 1/46* | (2006.01) |

(52) U.S. Cl.

CPC ..... *B22D 11/0637* (2013.01); *C21D 8/00* (2013.01); *C21D 8/0263* (2013.01); *C21D 9/52* (2013.01); *C22C 38/00* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *B21B 1/463* (2013.01); *B22D 11/001* (2013.01); *C21D 2211/005* (2013.01); *C21D 2211/009* (2013.01)

(56) References Cited

U.S. PATENT DOCUMENTS

| | | | | |
|---|---|---|---|---|
| 2003/0116232 | A1* | 6/2003 | Marchionni et al. | 148/320 |
| 2008/0219879 | A1 | 9/2008 | Williams et al. | |
| 2011/0155288 | A1* | 6/2011 | Ming | 148/503 |

FOREIGN PATENT DOCUMENTS

| | | | | |
|---|---|---|---|---|
| CN | 102002628 | A | | 4/2011 |
| JP | 2000212694 | | | 8/2000 |
| JP | 2009174006 | A | * | 8/2009 |

OTHER PUBLICATIONS

PCT International Preliminary Report on Patentability and Written Opinion for PCT Application No. PCT/CN2013/000153 dated Sep. 16, 2014 (15 pages).

* cited by examiner

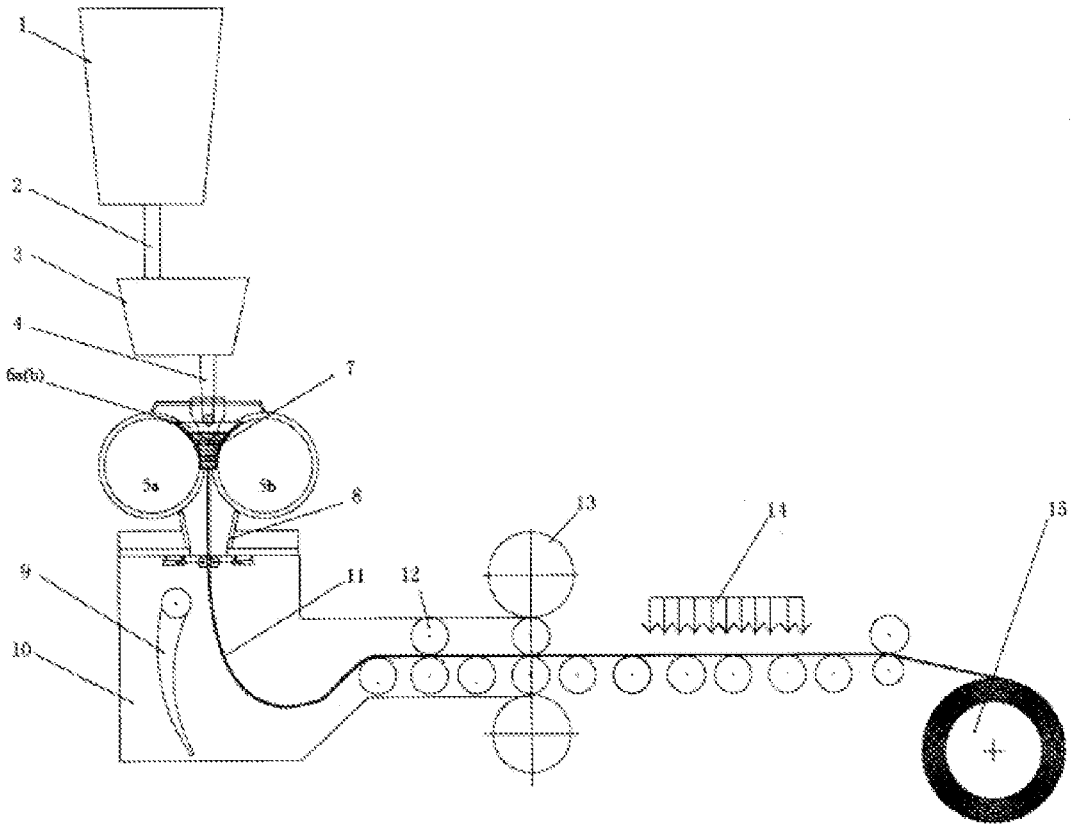
1
2
3
4
6a(b)
7
5a
5b
8
9
10
11
12
13
14
15

MANUFACTURING METHOD FOR STRIP CASTING 550 MPA-GRADE HIGH STRENGTH ATMOSPHERIC CORROSION-RESISTANT STEEL STRIP

CROSS REFERENCE TO RELATED APPLICATIONS

This application claims the priority benefit of PCT/CN2013/000153 filed on Feb. 18, 2013 and Chinese Application No. 201210067081.8 filed on Mar. 14, 2012. The contents of these applications are hereby incorporated by reference in their entirety.

TECHNICAL FIELD

The present invention involves the continuous strip casting process, and specifically the manufacturing method of a continuous strip cast atmospheric corrosion-resistant steel strip having a high-strength of 550 MPa-grade; wherein, the steel strip has a yield strength of 550 MPa or above, a tensile strength of 650 MPa or above, an elongation of 22% or above and qualified 180° bending property, as well as a superior strength and plasticity matching, and has a microstructure mainly comprising fine polygonal ferrite and pearlite.

BACKGROUND TECHNOLOGY

Atmospheric corrosion-resistant steel, also called weather-resistant steel, refers to the low-alloy structural steel having a protective rust layer of atmospheric corrosion resistance, which can be used to make vehicles, bridges, towers, containers and other steel structures. Compared with plain carbon steel, weather-resistant steel has a more excellent corrosion-resistant performance in atmosphere; compared with stainless steel, weather-resistant steel only contains trace amounts of alloy elements like P, Cu, Cr, Ni, Mo, Nb, V, Ti, etc., the total amount of which accounts for only a couple of percentage points (in the case of stainless steel, it accounts for a dozen of percentage points), so its price is relatively lower.

The atmospheric corrosion-resistant steel types frequently used in recent years are 09CuPTiRE of 295 MPa-grade, 09CuPCrNi of 345 MPa-grade and Q450NQR1 of 450 MPa. With the development of national economy, requirements are increasing on vehicle weight reduction, speed acceleration, freight volume increase, service life extension, logistics cost reduction, etc., above-mentioned steel types can no longer meet the requirements, so developing high-strength, highly corrosion-resistant and low-cost atmospheric corrosion-resistant steel presents important practical value and economic significance.

At present, many patents have been applied for on high-strength atmospheric corrosion-resistant steel and its manufacturing method both at home and abroad, wherein the atmospheric corrosion-resistant steel having a strength of 550 MPa-grade, the (Nb, V, Ti and Mo) multi-microalloying technology is generally used to improve its comprehensive mechanical property through refined crystalline strengthening and precipitation strengthening.

Chinese Patent 200510111858.6 discloses a high-strength and low-alloy atmospheric corrosion-resistant steel and its manufacturing method, by which the atmospheric corrosion-resistant steel sheet is manufactured with the chemical composition as follows: C 0.05~0.1%, Si≤0.75%, Mn 1.0~1.6%, P≤0.02%, S≤0.01%, Al 0.01~0.05%, Cr 0.2~0.45%, Ni 0.12~0.4%, Cu 0.2~0.55%, Ca 0.001~0.006%, N 0.001~0.006%, and at least two elements selected from Nb, Ti and Mo having a content of Nb≤0.07%, Ti≤0.025% and Mo≤0.35%, and balance being Fe and inevitable impurities. The steel sheet thus manufactured has a yield strength of 550 MPa or above, a tensile strength of 600 MPa or above and an elongation of 18% or above.

Chinese Patent 200910301054.0 discloses a high-strength atmospheric corrosion-resistant steel and its manufacturing method, by which the atmospheric corrosion-resistant steel sheet is manufactured with the chemical composition as follows C≤0.12%, Si≤0.75%, Mn≤1.5%, P≤0.025%, S≤0.008%, Cr 0.3~1.25%, Ni 0.12~0.65%, Cu 0.2~0.55%, Nb 0.015~0.03%, V 0.09~0.15%, Ti 0.006~0.02% and N 0.01-0.02%, and balance being Fe and inevitable impurities. The steel sheet thus manufactured has a yield strength of 550 MPa or above, a tensile strength of 650 MPa or above and an elongation of 18% or above.

The microalloying technology and the traditional hot rolling process have both been employed in the manufacture of all above-mentioned types of atmospheric corrosion-resistant steel having a high-strength of 550 MPa-grade, which is composed of such alloy elements like Nb, V, Ti and Mo in their component systems. The traditional hot rolling process is: continuous casting+reheating and thermal insulation of the casting slab+rough rolling+finishing rolling+cooling+coiling, firstly the casting slab of about 200 mm in thickness is produced by continuous casting, next it is subjected to reheating and thermal insulation, and then to rough rolling and finishing rolling to obtain the steel strip generally greater than 2 mm in thickness, and finally the steel strip is subjected to laminar cooling and coiling to complete the entire hot rolling manufacturing process. If a steel strip less than 2 mm in thickness is to be manufactured, generally the hot-rolled steel strip needs to be subjected to further cold rolling and subsequent annealing. However, there are the following main problems existing in the traditional process manufacturing microalloyed high-strength atmospheric corrosion-resistant steel, (1) The manufacturing cost is high caused by long process flow, high energy consumption, multiple unit equipment, high infrastructure construction cost.

(2) Given that the atmospheric corrosion-resistant steel contains relatively high contents of P, Cu and other easy-segregation elements which can improve the atmospheric corrosion-resistant performance of the steel strip, the traditional process, due to the low solidification and cooling rates of the casting slab, may easily cause the macroscopic segregation of P, Cu and other easy-segregation elements and result in the anisotropy, macroscopic cracking and further low yield of the casting slab.

(3) The weather-resistant performance of the atmospheric corrosion-resistant steel is mainly determined by the combined action of P and Cu. Due to its easy segregation characteristic in the traditional process, P is frequently omitted from the composition design of the high-strength atmospheric corrosion-resistant steel manufactured by the traditional process, and its content is controlled by the level of an impurity element, i.e., usually ≤0.025%; the additive amount of Cu is in the range of 0.2~0.55%, usually equal to the lower limit in the actual manufacturing practice. The result of said practice is the low weather-resistant performance of the steel strip.

(4) In the traditional process, the microalloy elements cannot be kept in the form of solid solution in the hot rolling process and usually go through partial precipitation and led to the increase of steel strength, which thus significantly increases the rolling load, raises energy consumption and roller consumption, causes significant damage to equipment and therefore limits the thickness range of the high-strength hot-rolled weather-resistant product which can be economically and practically manufactured (i.e., usually ≥2 mm). Continuously subjecting the traditional hot-rolled product to cold rolling can further reduce the thickness of the steel strip. However, the high strength of the hot-rolled steel strip may also result in difficulties in cold rolling, in that the high cold rolling load imposes a relatively high requirement on equipment and causes relatively significant damages and that the second phase segregated from the alloy elements in the hot-rolled product significantly increases the recrystallization annealing temperature of the cold-rolled steel strip.

(5) When manufacturing a high-strength product containing microalloy elements by the traditional process, the principle of refining austenite grains through deformation is usually employed, thus, the initial rolling temperature of finishing rolling is usually lower than 950° C., and its final rolling temperature is around 850° C. Therefore, when rolling under a relatively low temperature and combined with the increase of deformation with the progress of the rolling process, the strength of the steel strip are significantly increased, thus, the difficulty and consumption of hot rolling are significantly increased.

If the thin slab continuous casting and rolling process is employed to manufacture the microalloyed high-strength atmospheric corrosion-resistant steel, such disadvantages of the traditional process may be overcome to a certain extent. The thin slab continuous casting and rolling process, i.e., continuous casting+thermal insulation and soaking of the casting slab+thermal continuous rolling+cooling+coiling, distinguishes itself from the traditional process mainly in the following aspects: Firstly, in the case of the thin slab continuous casting and rolling process, the thickness of the casting slab is significantly reduced to 50~90 mm. Since the casting slab is thin, the casting slab only needs to go through 1~2 passes of rough rolling (the thickness of the casting slab ranging between 70 mm and 90 mm) or does not have to go through any rough rolling (the thickness of the casting slab less than 50 mm). In the case of the traditional process, on the contrary, the casting slab needs to repeatedly go through multiple passes of rolling before being thinned to the specification required before finishing rolling. Secondly, in the case of the thin slab continuous casting and rolling process, the casting slab directly enters the soaking furnace for soaking without cooling and thermal insulation (or for small amount of temperature compensation), thus, the thin slab continuous casting and rolling process significantly shortens the process flow, reduces energy consumption, saves investment and reduces the manufacturing cost. Thirdly, in the case of the thin slab continuous casting and rolling process, the solidification and cooling rates of the casting slab are accelerated, which can reduce the macroscopic segregation of the easy-segregation elements to a certain extent and thus reduce product defects and improve the yield of products. Because of this, the composition design of the microalloyed high-strength atmospheric corrosion-resistant steel manufactured by the thin slab continuous casting and rolling process has widened the range of content of increasing corrosion-resistant elements P and Cu, which is favorable for improving the weather-resistant performance of the steel.

The thin slab continuous casting and rolling process enjoys said advantages in the manufacture of microalloyed high-strength atmospheric corrosion-resistant steel, however, some problems existing in the traditional process still persist in the thin slab continuous casting and rolling process. For example, the microalloy elements cannot be kept in the form of solid solution in the hot rolling process and usually go through partial precipitation and lead to the improvement of steel strength, which thus significantly increases the rolling load, increases energy consumption and roller consumption, and therefore limits the thickness range of the high-strength hot-rolled weather-resistant product which can be economically and practically manufactured (i.e., thickness of 1.5 mm or above). See details in Patents 200610123458.1, 200610035800.2 and 200710031548.2.

The continuous strip casting technology is a cutting-edge technology in metallurgy and material research fields, and its emergence has brought about a revolution in the steel industry and changed the manufacturing process of the steel strip in the traditional metallurgical industry. Besides integrating such procedures like continuous casting, rolling and even thermal treatment makes one-stop production of the thin steel strip from the produced thin steel slab through only one pass of online rolling, it also significantly simplifies the manufacturing procedure, shortens the manufacturing cycle (with a process line only 50 m in length), correspondingly saves equipment investment and greatly reduces the product cost.

The twin-roller continuous strip casting process is a primary form of the continuous strip casting process, and also the only industrialized form of the continuous strip casting process. In the twin-roller continuous strip casting process, the molten steel is introduced from the steel ladle through the long nozzle, tundish and submersed nozzle to the molten pool formed by a pair of relatively rotating and internally water-cooling casting rollers and the side dams, and forms solidified shells on the mobile roller surface which then assemble in the clearance between the two casting rollers, thus forming the cast strip pulled out downward from the roller clearance. After that, the casting strip is delivered to the roller bed through the swinging guide plate and pinch roller, and then goes from the online hot rolling mill through the spray cooling and flying shear to the coiling machine until the manufacture of continuous strip casting products is completed.

So far there has been no report on employing the continuous strip casting technology to manufacture the microalloyed high-strength atmospheric corrosion-resistant steel, and such approach may present the following advantages:

(1) The continuous strip casting process eliminated several complex processes like slab heating, multi-pass repeated hot rolling, etc., and directly provides one-pass online hot rolling for the thin cast strip, which significantly reduces the manufacturing cost.

(2) The cast strip produced by the continuous strip casting process usually has a thickness of 1~5 mm, and can have an expected product thickness through online hot rolling (i.e., usually 1~3 mm), and the manufacture of low-thickness products does not need the cold rolling process.

(3) When the continuous strip casting process is employed to manufacture low-carbon microalloyed steel, such added alloy elements like Nb, V, Ti and Mo mainly exist in the form of solid solution in the hot rolling process, so the steel strip has a relatively low strength, the reduction rate of hot rolling by a single-standard hot rolling mill can reach as high as 30~50%, and the thinning efficiency of the steel strip is relatively high.

(4) When the continuous strip casting process is employed to manufacture low-carbon microalloyed steel, the high-temperature cast strip is directly subjected to hot rolling, and such added alloy elements like Nb, V, Ti and Mo primarily exist in the form of solid solution in the process, so the utilization rate of these alloy elements can be improved. In comparison, in the traditional process, the precipitation of these alloy elements occurs in the cooling process of the slab, and an inadequate redissolution of these alloy elements will occur when the slab is reheated, as a result of which the utilization rate of these alloy elements is reduced.

However, the atmospheric corrosion-resistant steel is a type of relatively special products. It is usually required to have a superior strength and plasticity matching, so even on products with a relatively high strength grade, a relatively high requirement is imposed with respect to their elongation, otherwise the requirements of the forming process cannot be met. When using the products which are manufactured by the continuous strip casting process and contain such microalloy elements like Nb, V, Ti and Mo, the inhibitory action of these microalloy elements to the recrystallization of the hot-rolled austenite may retain the inhomogeneity of the steel strip's coarse austenite grains. As a result, the microstructure of the final product produced through the phase change of the inhomogeneous coarse austenite also tends to be inhomogeneous, as a result of which the elongation of the product is relatively low.

International Patents WO 2008137898, WO 2008137899 and WO 2008137900 as well as Chinese Patents 200880023157.9, 200880023167.2 and 200880023586.6 disclose the method for manufacturing a microalloyed steel strip of 0.3~3 mm in thickness by adopting the continuous strip casting and rolling process, wherein the steel strip is manufactured with the chemical composition as follows: C<0.25%, Mn 0.20~2.0%, Si 0.05~0.50% and Al<0.01%, and at least one element selected from Nb, V and Mo, having a content of Nb 0.01~0.20%, V 0.01~0.20% and Mo 0.05~0.50%. Under the process conditions of the hot rolling reduction rate of 20~40% and the coiling temperature of 700° C. or below, the microstructure of the hot-rolled strip is bainite+acicular ferrite. As disclosed in these patents, alloy elements are added to inhibit the recrystallization of the austenite after hot rolling, retain the coarse characteristic of the continuous strip casting austenite grains for hardenability improvement, and thus obtain the microstructure of bainite+acicular ferrite at room temperature. Moreover, the disclosure does not provide the temperature range adopted by the hot rolling, however, in papers related to these patents (C. R. Killmore, etc. Development of Ultra-thin Cast Strip Products by the CASTRIP® Process. AIS Tech, Indianapolis, Ind., USA, May 7~10, 2007), the hot rolling temperature adopted is reported as 950° C.

The continuous strip casting low-carbon microalloyed steel product manufactured by this method has a relatively high strength, and can reach a yield strength of 650 MPa and a tensile strength of 750 MPa within the range of said composition. However, the key problem is the low elongation of the product, the cause of which is explained below. The cast strip produced by the continuous strip casting process usually has coarse and extremely inhomogeneous austenite grains from as low as dozens of microns to as high as 700~800 microns or even in the magnitude of millimeter; the hot rolling reduction rate of the continuous strip casting process usually does not exceed 50%, and the effect of refining austenite grains through deformation is thus very insignificant. If these austenite grains are not refined through recrystallization, the inhomogeneous coarse austenite won't be effectively improved after hot rolling, and the bainite+acicular ferrite structure produced through the phase=transformation of the inhomogeneous coarse austenite will also be extremely inhomogeneous, as a result of which the elongation of the product will be relatively low.

In order to improve the strength and plasticity matching of the continuous strip casting microalloyed steel, Chinese Patent 02825466.X proposes the method for manufacturing a microalloyed steel strip 1~6 mm in thickness adopting the continuous strip casting and rolling process, by which the microalloyed steel has a chemical composition as follows: C 0.02~0.20%, Mn 0.1~1.6%, Si 0.02~2.0%, Al<0.05%, S<0.03%, P<0.1%, Cr 0.01~1.5%, Ni 0.01~0.5%, Mo<0.5%, N 0.003~0.012%, Ti<0.03%, V<0.10%, Nb≤0.035% and B<0.005%, and balance being Fe and inevitable impurities. The hot rolling of the cast strip is conducted corresponding to the austenite zone, austenite-ferrite two-phase zone or ferrite zone within the temperature range of 1,150-(Ar1-100)° C., with a hot rolling reduction rate of 15~80%. In the method, an online heating system (with the heating temperature ranging between 670° C. and 1,150° C.) is designed to be set behind the continuous strip casting and rolling mill, the purpose of which is the complete recrystallization of the strip hot rolled in different phase zones occurs after thermal insulation for a certain period, so as to achieve a superior strength and plasticity matching for the steel strip.

When employing such method to manufacture the continuous strip casting low-carbon microalloyed steel product, the steel strip produced can indeed be endowed with a superior strength and plasticity matching. For example, for the steel strip which has a chemical composition including C 0.048%, Mn 0.73%, Si 0.28%, Cr 0.07%, Ni 0.07%, Cu 0.18%, Ti 0.01%, Mo 0.02%, S 0.002%, P 0.008%, Al 0.005% and N 0.0065%, its yield strength, tensile strength and elongation are respectively 260 MPa, 365 MPa and 28%. However, employing such method of manufacture requires that an online heating system be added during product line design, and that the heating furnace must be of sufficient length to ensure heating uniformity as the length of heating time is determined by both casting speed and heating furnace length. In this case, it not only increases investment cost, but also significantly increases the area occupied by the continuous strip casting and rolling production line and reduces the advantages of the production line.

In conclusion, when employing the continuous strip casting process to manufacture the microalloyed high-strength atmospheric corrosion-resistant steel with a superior strength and plasticity matching, given the low thickness of the cast strip, it's impossible to refine austenite grains through deformation, so the key lies in how to properly refine austenite grains through recrystallization, endow the product with a refined and homogeneous microstructure and thus achieve a superior strength and plasticity matching.

SUMMARY OF THE INVENTION

The purpose of the present invention lies in providing the manufacturing method of a continuous strip cast atmospheric corrosion-resistant steel strip having a high-strength of 550 MPa-grade through rational composition and process design without additional manufacturing equipment, so as to realize the online recrystallization of the austenite after the hot rolling of the cast strip, refine austenite grains and improve their size homogeneity, endow the product with a more homogeneously-distributed and refined microstructure of ferrite and pearlite simultaneously achieve a relatively high strength and elongation.

In order to achieve said purpose, the technical proposal of the present invention is:

The manufacturing method of a continuous strip cast atmospheric corrosion-resistant steel strip having a high-strength of 550 MPa-grade, comprising following steps:

1) smelting, wherein the molten steel has a chemical composition by weight percentage as follows: C 0.03~0.08%, Si≤0.4%, Mn 0.6~1.5%, P 0.07~0.22%, S≤0.01%, N≤0.012%, Cu 0.25~0.8%, Cr 0.3~0.8% and Ni 0.12~0.4%, and at least one microalloy element selected from Nb, V, Ti, and Mo having a content of Nb 0.01~0.08%, V 0.01~0.08%, Ti 0.01~0.08% and Mo 0.1~0.4%, and balance being Fe and inevitable impurities;

2) continuous strip casting, wherein the molten steel is introduced into a molten pool formed by a pair of relatively rotating and internally water-cooled casting rollers and side dams, and is directly cast into the strip having a thickness of 1~5 mm through rapid solidification;

3) cooling the cast strip, wherein after being continuous cast and coming out of the casting rollers, the cast strip goes through an airtight chamber for cooling, the cooling rate is more than 20° C./sec.;

4) online hot rolling the cast strip under hot rolling temperature of 1,050~1,250° C., a reduction rate of 20~50%, and deformation rate of >20 $s^{-1}$, wherein the thickness of the steel strip after hot rolling is 0.5~3.0 mm, and the online austenite recrystallization occurs upon the hot rolling of the cast strip;

5) cooling and coiling, wherein the cooling rate of the hot-rolled strip is controlled to be 10~80° C./sec., and the coiling temperature of the hot-rolled strip is controlled to be 570~720° C.; and wherein the final resulted steel strip has microstructure substantially consisting of fine polygonal ferrite and pearlite.

Wherein, in step 1), the content of each of Nb, V and Ti by weight percentage is 0.01~0.05%, and the content of Mo is 0.1~0.25% by weight percentage.

Wherein, in step 3), the cooling rate is greater than 30° C./sec.

Wherein, in step 4), the hot rolling temperature is in the range of 1,100~1,250° C., or in the range of 1,150~1,250° C.

Wherein, in step 4), the reduction rate of hot rolling is 30~50%.

Wherein, in step 4), the deformation rate is >30 $s^{-1}$.

Wherein, in step 5), the cooling rate of the hot-rolled strip is in the range of 30~80° C./sec.

Wherein, in step 5), the coiling temperature is in the range of 620~720° C.

The present invention is radically different from before-mentioned inventions in that, it adopts different composition range and process route to control and realize the online recrystallization of the austenite after hot rolling of the cast strip, to manufacture the atmospheric corrosion-resistant steel strip with more homogeneously-distributed and refined polygonal microstructure of ferrite and pearlite and simultaneously achieve a relatively ideal matching of strength and elongation.

The technical design of the present invention is described below:

(1) Appropriate amounts of microalloy elements Nb, V, Ti and Mo are added in the low-carbon steel to play a part mainly in two aspects:

First, to bring into play their role of solid-solution strengthening and improve the strength of the steel strip;

Second, to drag the austenite grain boundary via the solute atoms, inhibit the growth of austenite grains to a certain extent, and thus refine austenite grains and promote the recrystallization of the austenite. The more refined the austenite grains in size, the higher the dislocation density produced in deformation, and the higher the stored energy of deformation, as a result of which the driving force of recrystallization will be enhanced to promote the recrystallization process. Besides, given that the crystallization nuclei are formed mainly at or near the original high-angle grain boundary, the more refined the austenite grains in size (i.e., the higher the grain boundary area), and the easier for the formation of the crystallization nuclei, which thus promotes the recrystallization process.

(2) Utilizing the rapid solidification and rapid cooling characteristics of the steel strip in the continuous strip casting process and properly controlling the cooling rate of the cast strip can help to effectively control the segregation of P and Cu and thus realize the addition of relatively high amounts of P and Cu in the low-carbon steel which can improve the atmospheric corrosion-resistant performance of the steel strip. Meanwhile, adding appropriate amounts of alloy elements Cr and Ni can further improve both the atmospheric corrosion-resistant performance and hardenability of the steel strip.

(3) Appropriately increasing the hot rolling temperature in the austenite zone (deformation and recrystallization temperature) promotes the recrystallization of the austenite. With the rise of the deformation temperature both the recrystallization nucleation rate and growth rate present an exponentially-correlated growth (Microalloyed Steel—Physical and Mechanical Metallurgy, by YONG Qilong), i.e., the higher the temperature, the easier the recrystallization.

(4) Controlling the reduction rate (deformation quantity) of hot rolling within an appropriate range promotes the recrystallization of the austenite. Deformation is not only the basis of recrystallization, but also the driving force of recrystallization, i.e., the source of stored energy of such deformation. Given that recrystallization occurs only after the driving force has reached a certain level, only a certain quantity of deformation can initiate recrystallization. The higher the deformation quantity, the higher the stored energy of deformation, and the higher the recrystallization nucleation rate and growth rate, which means that recrystallization can be started and finished at a sufficiently rapid rate even at a relatively low temperature. Further, a higher quantity of deformation also reduces the size of austenite grains after recrystallization, as the recrystallization nucleation rate presents an exponentially-correlated growth with the rise of the stored energy of deformation (Microalloyed Steel—Physical and Mechanical Metallurgy, by YONG Qilong). Thus, it helps to obtain more refined austenite phase transformation product, and improve the strength and plasticity of the steel strip.

(5) Controlling the deformation rate within an appropriate range promotes the recrystallization of the austenite. Increasing the deformation rate will increase the stored energy of deformation, and thus increase the driving force of recrystallization and promote the recrystallization process.

In the design of chemical composition of the present invention:

C: C is the most economic and basic strengthening element in steel, and improves the strength of steel by means of solid-solution strengthening and precipitation strengthening. C is also an indispensable element for the precipitation of the cementite in the transformation process of the austenite. Thus, the content level of C determines to a large extent the strength grade of steel, i.e., a relatively high content of C corresponds to a relatively high grade of steel strength. However, given that the interstitial solid solution and precipitation of C relatively significantly damage both the plasticity and toughness of steel and that an excessively high content of C harms the welding performance of steel, the content of C should not be excessively high, and the strength of steel may be supplemented by adding appropriate amounts of alloy elements. Thus, in the present invention, the content of C is controlled to be in the range of 0.03~0.08%.

Si: Si plays a role of solid-solution strengthening in steel, and can improve steel purity and promote steel deoxidation when added. However, an excessively high content of Si deteriorates both the weldability of steel and the toughness of the zone affected by welding heat. Thus, in the present invention, the content of Si is controlled to be 0.4% or below.

Mn: As one of the cheapest alloy elements having a considerably high solid solubility in steel, Mn can improve the hardenability of steel, and improve its strength through solid-solution strengthening while imposing basically no damage on the plasticity or toughness of steel. Thus, it is the most important strengthening element which can improve the strength of steel in circumstances where the content of C is reduced. However, an excessively high content of Mn deteriorates both the weldability of steel and the toughness of the zone affected by welding heat. Thus, in the present invention, the content of Mn is controlled to be in the range of 0.6~1.5%.

P: P can significantly improve the atmospheric corrosion-resistant performance of steel and greatly refine austenite grains. However, a high content of P is susceptible to segregation at grain boundary, increases the cold brittleness of steel, deteriorates its welding performance and cold-bending property and reduces its plasticity. Thus, as far as the atmospheric corrosion-resistant steel manufactured by the traditional process at present is concerned, P is in most cases controlled as an impurity element, with its content controlled at an extremely low level.

In the continuous strip casting process, both the solidification and cooling rates of the cast strip are extremely high, which can effectively inhibit the segregation of P and thus effectively avoid its disadvantages, fully bring into play its advantages, improve the atmospheric corrosion-resistant performance of steel and promote the recrystallization of the austenite by refining austenite grains. Thus, in the present invention, P content higher than that adopted in the manufacture of the atmospheric corrosion-resistant steel by the traditional process is adopted, i.e., ranging between 0.07%~0.22%.

S: In normal circumstances S is also a harmful element in steel which produces the hot brittleness of steel, reduces its ductility and toughness and causes cracks in the rolling process. S also reduces the welding performance and corrosion-resistant performance of steel. Thus, in the present invention, S is controlled as an impurity element, with its content controlled to be 0.01% or below.

Cr: Cr can effectively improve the atmospheric corrosion-resistant performance, hardenability and strength of steel, however, a high content of Cr deteriorates its plasticity, toughness and welding performance. Thus, in the present invention, the content of Cr is controlled to be in the range of 0.3~0.8%.

Ni: Ni can not only effectively improve the atmospheric corrosion-resistant performance of steel but also effectively improve its strength through solid-solution strengthening, without significantly influencing its plasticity and toughness and imposing only an extremely insignificant influence on the weldability of steel and the toughness of the zone affected by welding heat. Besides, Ni can also effectively prevent the hot brittleness brought about by Cu. However, a high content of Ni will significantly increase the cost of steel. Thus, in the present invention, the content of Ni is controlled to be in the range of 0.12~0.4%.

Cu: Cu is a key element in improving the atmospheric corrosion-resistant performance of steel, and presents a more significant effect when used in combination with P. Besides, Cu can also bring into play its action of solid-solution strengthening to improve the strength of steel without adversely influencing its welding performance. However, as an easy-segregation element, Cu is easy to cause the hot brittleness of steel in hot processing. Thus, as far as the atmospheric corrosion-resistant steel manufactured by the traditional process at present is concerned, the content of Cu is generally controlled to be 0.6% or below.

In the continuous strip casting process, both the solidification and cooling rates of the cast strip are extremely high, which can effectively inhibit the segregation of Cu and thus effectively avoid its disadvantages and fully bring into play its advantages. Thus, in the present invention, Cu content higher than that adopted in the manufacture of the atmospheric corrosion-resistant steel by the traditional process is adopted, i.e., ranging between 0.25% and 0.8%.

Nb: Among the commonly-used four microalloy elements, i.e., Nb, V, Ti and Mo, Nb is the alloy element which can most powerfully inhibit the recrystallization of the austenite after hot rolling. In the microalloyed steel manufactured by the traditional controlled rolling, usually Nb is added first to play a role of strengthening, and second to inhibit the recrystallization of the austenite after hot rolling, thus realizing the purpose of refining austenite grains through deformation. Based on the dragging mechanism by the solute atoms and the pinning mechanism by the second-phase particles of the Nb carbonitride precipitated, Nb can effectively prevent the migration of the high-angle grain boundary and subgrain boundary and thus significantly prevent the recrystallization process. In the process, the action of the second-phase particles in preventing recrystallization is more significant.

Based on the unique rapid solidification and rapid cooling characteristics of the steel strip in the continuous strip casting process, the alloy element Nb added may exist mainly in the form of solid solution in the steel strip, and almost no precipitation of Nb can be observed even when the steel strip is cooled down to room temperature. Thus, although the alloy element Nb can effectively inhibit the recrystallization of the austenite, only relying on the solute atoms (instead of bring into play the action of the second-phase particles) to realize such inhibitory effect may be extremely difficult in many circumstances. For example, when both the deformation temperature and deformation quantity are relatively high, the recrystallization of the austenite may still occur even when the alloy element Nb is added.

On the other hand, the alloy element Nb existing in the form of solid solution in steel can drag the austenite grain boundary via the solute atoms, inhibit the growth of austenite grains to a certain extent, and thus refine austenite grains and promote the recrystallization of the austenite. In this sense, Nb helps to promote the recrystallization of the austenite after hot rolling.

In the present invention, on the one hand, the action of solid-solution strengthening of Nb should be brought into play to improve the strength of steel; on the other hand, the inhibitory effect of Nb for the recrystallization of the austenite should be reduced to the minimum. Thus, the designed content of Nb in the present invention is in the range of 0.01~0.08%. Preferably the content of Nb is controlled to be in the range of 0.01~0.05%, so that the steel strip may be endowed with a more superior strength and plasticity matching.

V: Among the commonly-used four microalloy elements, i.e., Nb, V, Ti and Mo, V has the weakest effect in inhibiting the recrystallization of the austenite. In the steel manufactured through recrystallization controlled rolling, usually V is added first to play a role of strengthening, and second to realize the purpose of refining austenite grains through recrystallization, as its inhibitory effect for recrystallization is relatively insignificant.

In the continuous strip casting process, V also exists mainly in the form of solid solution in the steel strip, and almost no precipitation of V can be observed even when the steel strip is cooled down to room temperature. Thus, the inhibitory effect of V for the recrystallization of the austenite is very limited. If it's required both that the action of solid-solution strengthening of alloy elements be brought into play to improve the strength of steel and that the inhibitory effect of these alloy elements for the recrystallization of the austenite be reduced to the minimum, then V is a relatively ideal alloy element which best suits to the design of the present invention.

On the other hand, the alloy element V existing in the form of solid solution in steel can drag the austenite grain boundary via the solute atoms, inhibit the growth of austenite grains to a certain extent, and thus refine austenite grains. In this sense, V helps to promote the recrystallization of the austenite after hot rolling.

In the present invention, the content of V adopted is in the range of 0.01~0.08%. Preferably the content of V is controlled to be in the range of 0.01~0.05%, so that the steel strip may be endowed with a more superior strength and plasticity matching.

Ti: Among the commonly-used four microalloy elements, i.e., Nb, V, Ti and Mo, Ti has strong inhibitory effect for the recrystallization of the austenite only second to that of Nb and superior to that of Mo and V. In this regard, Ti goes against the promotion of the recrystallization of the austenite. However, Ti has a prominent advantage in that, it has a very low solid solubility and can form considerably stable second-phase particles TiN about 10 nm in size at high temperature, prevent the coarsening of austenite grains during soaking and thus promote the action of recrystallization. Thus, in the steel manufactured through recrystallization controlled rolling, usually a trace amount of Ti is added to refine austenite grains and promote the recrystallization of the austenite.

In the continuous strip casting process, Ti exists mainly in the form of solid solution in the thermal-state steel strip, and if the steel strip is cooled down to room temperature, a little amount of precipitation of Ti may be observed. Thus, the inhibitory effect of Ti for the recrystallization of the austenite is very limited.

On the other hand, the alloy element Ti existing in the form of solid solution in steel can drag the austenite grain boundary via the solute atoms, inhibit the growth of austenite grains to a certain extent, and thus refine austenite grains. In this sense, Ti helps to promote the recrystallization of the austenite after hot rolling.

In the present invention, on the one hand, the action of solid-solution strengthening of Ti should be brought into play to improve the strength of steel; on the other hand, the inhibitory effect of Ti for the recrystallization of the austenite should be reduced to the minimum. Thus, the designed content of Ti in the present invention is in the range of 0.01~0.08%. Preferably the content of Ti is controlled to be in the range of 0.01~0.05%, so that the steel strip may be endowed with a more superior strength and plasticity matching.

Mo: Among the four commonly used microalloy elements, i.e., Nb, V, Ti and Mo, Mo has relatively weak inhibitory effect for the recrystallization of the austenite, superior only to that of V.

In the continuous strip casting process, Mo also exists mainly in the form of solid solution in the steel strip, and almost no precipitation of Mo can be observed even when the steel strip is cooled down to room temperature. Thus, the inhibitory effect of Mo for the recrystallization of the austenite is very limited.

On the other hand, the alloy element Mo existing in the form of solid solution in steel can drag the austenite grain boundary via the solute atoms, inhibit the growth of austenite grains to a certain extent, and thus refine austenite grains and promote the recrystallization of the austenite. In this sense, Mo helps to promote the recrystallization of the austenite after hot rolling.

In the present invention, the content of Mo adopted is in the range of 0.1~0.4%. Preferably the content of Mo is controlled to be in the range of 0.1~0.25%, so that the steel strip may be endowed with a more superior strength and plasticity matching.

N: Similar to C, N can also improve the strength of steel through interstitial solid solution, however, its interstitial solid solution relatively significantly damages both the plasticity and toughness of steel, so the content of N cannot be too high. In the present invention, the content of N adopted is controlled to be 0.012% or below.

In the manufacturing process of the present invention:

Continuous strip casting, wherein the molten steel is introduced into a molten pool formed by a pair of relatively rotating and internally water-cooled casting rollers and side dams, and is directly cast into strip having a thickness of 1~5 mm through rapid solidification.

Cooling the cast strip, wherein after being continuous cast and coming out of the casting rollers, the cast strip goes through an airtight chamber for cooling. In order to rapidly lower the temperature of the cast strip, thus prevent the excessively rapid growth of austenite grains at high temperature and, more importantly, control the segregation of P and Cu, the cooling rate of the cast strip is controlled to be greater than 20° C./sec., and preferably is controlled to be greater than 30° C./sec. The cooling of the cast strip employs the method of gas cooling, and the pressure and flow of the cooling gas and the location of the gas nozzle can be employed for regulation and control. Cooling gases available comprise argon, nitrogen, helium and other inert gases, as well as the mixture of several types of gases. By controlling the type, pressure, flow of the cooling gas, the distance between the gas nozzle and the cast strip, etc., the cooling rate of the cast strip can be effectively controlled.

Online hot rolling the cast strip is controlled under a hot rolling temperature of 1,050~1,250° C., with the purposes of realizing the full crystallization of the austenite after hot rolling and refining austenite grains. In the chemical composition design of the present invention, microalloy elements Nb, V, Ti and Mo are added, which, as previously mentioned, can inhibit the recrystallization of the austenite to a certain extent, although such inhibitory effect will be weakened in the continuous strip casting process. However, when the hot rolling is carried out at a temperature lower than 1,050° C., it's very difficult for the full crystallization of the austenite to occur; when the hot rolling is carried out at a temperature higher than 1,250° C., due to the strength reduction of the steel strip, it's very difficult to control the hot rolling process. Thus, the present invention adopts a rolling temperature range of 1,050~1,250° C. Preferably the temperature of hot rolling is in the range of 1,100~1,250° C., or 1,150~1,250° C. The reduction rate of hot rolling is controlled to be 20~50%, and increasing the reduction of hot rolling will promote the crystallization of the austenite and refine austenite grains. Preferably the reduction rate of hot rolling is controlled to be in the range of 30~50%. The deformation rate of hot rolling is controlled to be >20 $s^{-1}$, and increasing the deformation rate of hot rolling will promote the crystallization of the austenite. Preferably the deformation rate of hot rolling is controlled to be >30 $s^{-1}$. The thickness of the steel strip after hot rolling is in the range of 0.5~3.0 mm.

Cooling of the hot-rolled strip, wherein, gas spray cooling, laminar cooling, spraying cooling or other cooling methods are employed for the cooling of the hot-rolled strip. The flow quantity, flow velocity, water outlet location and other parameters of the cooling water can be regulated to control the cooling rate of the hot-rolled strip. The cooling rate of the hot-rolled strip is controlled to be 10~80° C./sec, and the hot-rolled strip is cooled down to the coiling temperature required. The cooling rate is an important factor influencing the actual starting temperature of the phase transformation of the austenite, i.e., the higher the cooling rate, the lower the actual starting temperature of the phase transformation of the austenite, and the more refined the grain size of the microstructure produced after phase transformation, which thus helps to improve the strength and toughness of the steel strip. Preferably the cooling rate of the hot-rolled strip is controlled to be in the range of 30~80° C./sec.

Coiling of the hot-rolled strip, wherein, the coiling temperature of the hot-rolled strip is controlled to be 570~720° C., so as to endow the hot-rolled strip with the microstructural characteristic of bainite and acicular ferrite. Preferably the coiling temperature of the hot-rolled strip is controlled to be in the range of 620~720° C.

Compared with existing patents in which the traditional process is employed to manufacture high-strength atmospheric corrosion-resistant steel, the present invention has the following advantages:

(1) The present invention employs the continuous strip casting process, fully brings into play its features like short process flow, low energy consumption, high efficiency, simple process, etc., and thus significantly reduces the manufacturing cost of the microalloyed high-strength and low-thickness atmospheric corrosion-resistant steel 0.5~3 mm in thickness.

(2) Having employed the continuous strip casting process and properly controlled the cooling rate of the cast strip, the present invention can effectively inhibit the segregation of P and Cu, increase the upper limit of the Cu content of the microalloyed high-strength atmospheric corrosion-resistant steel from the 0.55% of the traditional process to the present 0.8%, and raise the upper limit of the P content of the microalloyed high-strength atmospheric corrosion-resistant steel from the 0.025% of the traditional process to the present 0.22%.

Compared with the existing Chinese Patents 200880023157.9, 200880023167.2 and 200880023586.6 which employ the continuous strip casting process to manufacture microalloyed high-strength steel, the present invention is distinguished in the following aspects:

Chinese Patents 200880023157.9, 200880023167.2 and 200880023586.6 present the addition of microalloy elements to inhibit the recrystallization of the austenite after hot rolling, and to obtain microstructure of bainite+acicular ferrite for the steel strip. However, the bainite+acicular ferrite microstructure produced from the inhomogeneous coarse austenite through the phase transformation will also be extremely inhomogeneous, as a result of which the elongation of the product will be relatively low. The present invention realizes the online recrystallization of the austenite after hot rolling by controlling the additive amounts of microalloy elements, the temperature of hot rolling, the reduction rate of hot rolling and the deformation rate of hot rolling, and thus achieves homogeneous microstructure of bainite+acicular ferrite and superior strength and plasticity matching for the steel strip. Besides, in order to improve the atmospheric corrosion-resistant performance of steel, the chemical composition of the present invention is designed to contain P, Cu, Cr and Ni, which, as a matter of fact, correspond to the manufacture of a different type of steel.

Compared with the existing Chinese Patent 02825466.X which employs the continuous strip casting process to manufacture microalloyed steel, the present invention is distinguished in the following aspects:

While the Chinese Patent 02825466.X controls the recrystallization of the austenite after hot rolling by adding an online heating system, in the present invention, the recrystallization of the austenite after hot rolling is controlled by controlling the additive amounts of microalloy elements, the temperature of hot rolling, the reduction rate of hot rolling and the deformation rate of hot rolling. Besides, in order to improve the atmospheric corrosion-resistant performance of steel, the chemical composition of the present invention is designed to contain P, Cu, Cr and Ni, which, as a matter of fact, correspond to the manufacture of different type of steel.

Beneficial Effects of the Present Invention

Based on rational design of chemical composition, rational control of the cooling rate of the cast strip and rational design of the temperature, reduction rate and deformation rate of hot rolling in the continuous strip casting manufacturing process, the present invention is intended to control and realize the online recrystallization of the austenite after the hot rolling of the cast strip containing microalloy elements, manufacture the atmospheric corrosion-resistant steel strip with a refined polygonal microstructure of ferrite and pearlite and a relatively ideal matching of strength and elongation.

BRIEF DESCRIPTION OF DRAWINGS

FIG. 1 is a schematic diagram showing the continuous strip casting process flow.

DESCRIPTION OF THE PREFERRED EMBODIMENTS

Referring to FIG. 1, the continuous strip casting process flow of the present invention is described below: The molten steel in the large steel ladle 1 is introduced through the long nozzle 2, tundish 3 and submersed nozzle 4 to the molten pool 7 formed by a pair of relatively rotating and internally water-cooling casting rollers (5*a* and 5*b*) and the side dams (6*a* and 6*b*), and forms the cast strip 11 1~5 mm in size through cooling by the water-cooling casting rollers; the steel strip then goes through the secondary cooling device 8 in the airtight chamber 10 to control its cooling rate, and is then delivered to the hot rolling mill 13 through the swinging guide plate 9 and pinch roller 12; the hot-rolled strip 0.5~3 mm in size formed after hot rolling then goes through the third cooling device 14, and then goes into the coiling machine 15. The steel coil is then taken down from the coiling machine for natural cooling to room temperature.

In all examples of the present invention, the molten steel is produced through electric furnace smelting; see the specific chemical composition in Table 1 below. Table 2 provides the thickness and cooling rate of the cast strip produced after the continuous strip casting, the temperature, reduction rate and deformation rate of hot rolling, the thickness and cooling rate of the hot-rolled strip, the coiling temperature and other process parameters, as well as the tensile performance and bending property of the hot-rolled strip after cooling down to room temperature.

It can be seen from Table 2 that, the steel strip of the present invention has a yield strength of 550 MPa or above, a tensile strength of 650 MPa or above, an elongation of 22% or above and qualified 180° bending property, as well as a superior strength and plasticity matching.

TABLE 1

Chemical composition of the molten steel in the examples (wt. %)

| Example No. | C | Si | Mn | P | S | N | Cu | Cr | Ni | Nb | V | Ti | Mo |
|---|---|---|---|---|---|---|---|---|---|---|---|---|---|
| 1 | 0.053 | 0.26 | 0.85 | 0.17 | 0.004 | 0.0074 | 0.26 | 0.62 | 0.22 | | | 0.080 | 0.12 |
| 2 | 0.046 | 0.30 | 0.90 | 0.13 | 0.003 | 0.0061 | 0.41 | 0.50 | 0.34 | 0.024 | 0.048 | 0.010 | |
| 3 | 0.050 | 0.34 | 0.78 | 0.15 | 0.004 | 0.0058 | 0.53 | 0.52 | 0.30 | 0.080 | | | |
| 4 | 0.031 | 0.26 | 1.50 | 0.21 | 0.006 | 0.0087 | 0.37 | 0.80 | 0.12 | 0.011 | 0.080 | | |
| 5 | 0.044 | 0.34 | 1.25 | 0.09 | 0.005 | 0.0052 | 0.80 | 0.43 | 0.32 | 0.036 | | 0.035 | |
| 6 | 0.075 | 0.31 | 0.67 | 0.15 | 0.006 | 0.0046 | 0.50 | 0.35 | 0.40 | | 0.012 | | 0.40 |
| 7 | 0.062 | 0.40 | 1.42 | 0.07 | 0.008 | 0.0115 | 0.63 | 0.30 | 0.36 | 0.050 | 0.035 | | 0.25 |
| 8 | 0.080 | 0.25 | 0.60 | 0.18 | 0.007 | 0.0094 | 0.72 | 0.70 | 0.25 | | 0.060 | 0.050 | 0.32 |

TABLE 2

Process parameters and product performance of the examples

| Example No. | Thickness of cast strip, mm | Cooling rate of cast strip, ° C./sec. | Temperature of hot rolling, ° C. | Reduction rate of hot rolling, % | Deformation rate of hot rolling, $s^{-1}$ | Thickness of hot-rolled strip, mm | Cooling rate of hot-rolled strip, ° C./sec. | Coiling temperature, ° C. | Yield strength, MPa | Tensile strength, MPa | Elongation, % | 180° bending, Flexural center diameter a = strip thickness |
|---|---|---|---|---|---|---|---|---|---|---|---|---|
| 1 | 2.8 | 29 | 1,150 | 42 | 36 | 1.6 | 18 | 720 | 566 | 706 | 24 | Qualified |
| 2 | 3.0 | 38 | 1,053 | 26 | 38 | 2.2 | 25 | 645 | 593 | 716 | 22 | Qualified |
| 3 | 2.8 | 23 | 1,210 | 30 | 39 | 2.0 | 39 | 630 | 585 | 680 | 22 | Qualified |
| 4 | 4.8 | 26 | 1,228 | 38 | 34 | 3.0 | 74 | 570 | 598 | 702 | 23 | Qualified |
| 5 | 1.0 | 34 | 1,085 | 46 | 47 | 0.6 | 20 | 669 | 596 | 715 | 23 | Qualified |
| 6 | 2.6 | 25 | 1,240 | 30 | 26 | 1.8 | 62 | 616 | 595 | 693 | 22 | Qualified |
| 7 | 4.2 | 21 | 1,100 | 50 | 22 | 2.1 | 45 | 620 | 587 | 685 | 23 | Qualified |
| 8 | 3.5 | 32 | 1,250 | 25 | 45 | 2.6 | 16 | 695 | 570 | 680 | 24 | Qualified |

The invention claimed is:

1. A manufacturing method of a continuous strip cast atmospheric corrosion-resistant steel strip having a high-strength of 550 MPa-grade, the method sequentially comprising the following steps:

1) smelting, wherein the molten steel has a chemical composition by weight percentage as follows: C 0.03~0.08%, Si≤0.4%, Mn 0.6~1.5%, P 0.07~0.22%, 0<S≤0.01%, 0<N≤0.012%, Cu 0.25~0.8%, Cr 0.3~0.8% and Ni 0.12~0.4%, and at least one microalloy element selected from Nb, V, Ti, and Mo having a content of Nb 0.01~0.08%, V 0.01~0.08%, Ti 0.01~0.08% and Mo 0.1~0.4%, and balance being Fe and inevitable impurities;
2) continuous strip casting, wherein the molten steel is introduced into a molten pool formed by a pair of relatively rotating and internally water-cooled casting rollers and side dams, and is directly cast into a cast strip having a thickness of 1~5 mm through rapid solidification;
3) cooling the cast strip after the continuous strip casting, wherein after being continuously cast and coming out of the casting rollers, the cast strip goes through an airtight chamber for cooling, the cooling rate is 21° C./sec. to 38° C./sec.;
4) online hot rolling the cast strip after cooling the cast strip under a hot rolling temperature of 1,050~1,250° C., a reduction rate of 20~50%, and a deformation rate of >20 $s^{-1}$, wherein the thickness of the steel strip after hot rolling is 0.5~3.0 mm, and online austenite recrystallization occurs upon the hot rolling of the cast strip;
5) cooling and coiling after the online hot rolling the cast strip, wherein the cooling rate of the hot-rolled strip is controlled to be 16° C./sec. to 74° C./sec., and the coiling temperature of the hot-rolled strip is controlled to be 570~720° C.; and wherein the final resulting steel strip has a microstructure substantially consisting of fine polygonal ferrite and pearlite conferring a strength property and an elongation property to the steel strip.

2. The manufacturing method of a continuous strip cast atmospheric corrosion-resistant steel strip having a high-strength of 550 MPa-grade according to claim 1, wherein, in step 1), the content of each of Nb, V and Ti is 0.01~0.05% by weight percentage, and the content of Mo is 0.1~0.25% by weight percentage.

3. The manufacturing method of a continuous strip cast atmospheric corrosion-resistant steel strip having a high-strength of 550 MPa-grade according to claim 1, wherein, in step 4), the hot rolling temperature is in the range of 1,100~1,250° C.

4. The manufacturing method of a continuous strip cast atmospheric corrosion-resistant steel strip having a high-strength of 550 MPa-grade according to claim 1, wherein, in step 4), the hot rolling temperature is in the range of 1,150~1,250° C.

5. The manufacturing method of a continuous strip cast atmospheric corrosion-resistant steel strip having a high-strength of 550 MPa-grade according to claim 1 or claim 3, wherein, in step 4), the reduction rate of the hot rolling is 30~50%.

6. The manufacturing method of a continuous strip cast atmospheric corrosion-resistant steel strip having a high-strength of 550 MPa-grade according to claim 1 or claim 3, wherein, in step 4), the deformation rate of hot rolling is >30 $s^{-1}$.

7. The manufacturing method of a continuous strip cast atmospheric corrosion-resistant steel strip having a high-strength of 550 MPa-grade according to claim 5, wherein, in step 4), the deformation rate of hot rolling is 22 $s^{-1}$ to 47 $s^{-1}$.

8. The manufacturing method of a continuous strip cast atmospheric corrosion-resistant steel strip having a high-strength of 550 MPa-grade according to claim 1, wherein, in step 5), the cooling rate is in the range of 18° C./sec to 62° C./sec.

9. The manufacturing method of a continuous strip cast atmospheric corrosion-resistant steel strip having a high-strength of 550 MPa-grade according to claim 1 or claim 8, wherein, in step 5), the coiling temperature is in the range of 620~720° C.

10. The manufacturing method of a continuous strip cast atmospheric corrosion-resistant steel strip having a high-strength of 550 MPa-grade according to claim 1, wherein, the thickness of said steel strip is less than 3 mm.

11. The manufacturing method of a continuous strip cast atmospheric corrosion-resistant steel strip having a high-strength of 550 MPa-grade according to claim 1, wherein, the thickness of said steel strip is less than 2 mm.

12. The manufacturing method of a continuous strip cast atmospheric corrosion-resistant steel strip having a high-strength of 550 MPa-grade according to claim 1, wherein, the thickness of said steel strip is less than 1 mm.

13. The manufacturing method of a continuous strip cast atmospheric corrosion-resistant steel strip having a high-strength of 550 MPa-grade according to claim 1 or claim 10, wherein, said steel strip has a yield strength of 550 MPa or above, a tensile strength of 650 MPa or above, and an elongation of 22% or above.

* * * * *